United States Patent [19]

Dollens et al.

[11] Patent Number: 4,688,487

[45] Date of Patent: Aug. 25, 1987

[54] VEHICLE TRANSPORTATION SYSTEM

[75] Inventors: Donald L. Dollens; John D. Milner, both of Detroit, Mich.

[73] Assignee: Acco Babcock Inc., Fairfield, Conn.

[21] Appl. No.: 830,970

[22] Filed: Feb. 19, 1986

[51] Int. Cl.[4] ..... B60L 15/00

[52] U.S. Cl. ..... 104/298; 246/28 R; 191/14

[58] Field of Search ..... 104/298, 290, 295, 301; 246/28 R, 31, 66, 65, 67, 68, 2 S, 34 A, 48, 122 R; 340/933; 191/6, 14, 15

[56] References Cited

U.S. PATENT DOCUMENTS

| | | | |
|---|---|---|---|
| 1,617,402 | 2/1927 | Loughridge | 246/66 X |
| 3,506,823 | 4/1970 | Failor | 246/66 |
| 3,596,086 | 7/1971 | Etter | 246/66 |
| 3,874,301 | 4/1975 | Alimanestiano | 104/298 |
| 4,002,314 | 1/1977 | Barpal | 104/298 X |
| 4,063,699 | 12/1977 | Wallgard | 104/298 X |
| 4,095,764 | 6/1978 | Osada et al. | 104/298 X |

*Primary Examiner*—Randolph A. Reese
*Assistant Examiner*—Russell D. Stormer
*Attorney, Agent, or Firm*—Barnes, Kisselle, Raisch, Choate, Whittemore & Hulbert

[57] ABSTRACT

A vehicle transportation system which includes a self-propelled vehicle for propulsion along a track through a plurality of predefined sequential track zones. The vehicle receives power and control signals from a plurality of electrical buses which are positioned adjacent to the track and extend through the track zones. The buses for indicating presence of a vehicle within a zone and for arresting vehicle motion, as well as one of the velocity control buses, is segmented or discontinuous between adjacent zones, and bus segments are directly electrically connected or jumpered between adjacent zones for controlling vehicle motion and avoiding collision with a stalled vehicle.

4 Claims, 7 Drawing Figures

VEHICLE TRANSPORTATION SYSTEM

The present invention is directed to a system for transporting a self-propelled vehicle along a track through a plurality of sequentially positioned track zones, and more particularly to a system for controlling motion of several vehicles through the seqential zones while avoiding collision between adjacent vehicles.

BACKGROUND OF THE INVENTION

Systems for transporting self-propelled vehicles along a track have heretofore been proposed in the art and are employed, for example, for automated transport of workpieces among a plurality of work stations in an automated manufacturing environment, and also in personnel rapid transit systems. It is conventional practice for control purposes to divide at least a portion of the vehicle path into a plurality of sequential zones, and to control motion of the vehicle separately in each of the sequential zones. It has likewise been proposed to convey power and motion-control signals to an electronically-driven self-propelled vehicle through a plurality of buses parallel to the vehicle track and individually engaged by brushes or wipers carried by the vehicle.

Alimanestianu U.S. Pat. No. 3,874,301 discloses a system for controlling motion of a self-propelled vehicle wherein buses carrying velocity control signals are segmented at the sequential zones and individually connected to variable frequency oscillators or controlling synchronous propulsion motors carried by the vehicles. When applied to automated production lines or other environments wherein vehicles may become stalled in any of the track zones, applications of such variable frequency oscillator principles for controlling vehicle velocity has required use of programmable controllers or the like for detecting presence of a vehicle in any of the sequential zones and controlling velocity of subsequent vehicles accordingly. Such a system is expensive to implement and requires that a multiplicity of signal conductors extend along the vehicle track for substantial distances.

OBJECTS AND SUMMARY OF THE INVENTION

It is a general object of the present invention to provide a vehicle transportation system of the described character for controlling velocity of the vehicles through sequential zones while avoiding collision, which system is economical to implement, does not require either individual connection of the multiple zones to programmable controllers or like sening devices, or connection of the velocity control lines to variable frequency oscillators and the like, and may be readily implemented and maintained by unskilled or semi-skilled personnel.

A more specific object of the invention is to provide a vehicle transportation system of the described character which, in the event that a vehicle stops or stalls in a given track zone, automatically controls motion of upstream vehicles so as to avoid collision without requiring external control intervention.

A vehicle transportation system according to the present invention comprises a track and at least one self-propelled vehicle for propulsion along the track in a predetermined direction through a plurality of predefined sequential track zones. Bus bars are positioned adjacent to the track and extend in a direction parallel thereto through the track zones for conveying power and control signals to the vehicle. The vehicle includes brushes or the like for engaging the bus bars, a dc motor for propelling the vehicle along the track, and circuitry for controlling operation of the motor as a function of control signals on the bus bars.

In a preferred embodiment of the invention, the power and motion control bus bars include a first series of buses for applying ac power to the vehicle, a pair of buses for conveying vehicle speed control signals, a bus for receiving a signal from the vehicle indicative of vehicle presence within a zone, and a bus for conveying a travelpermit signal to the vehicle for enabling motion under control of the velocity-control buses. The travelpermit, the vehicle-present and one of the velocity control buses are segmented in each of the adjacent zones—i.e. are discontinuous between adjacent zones. In accordance with a distinguishing feature of the present invention, direct electrical connection means—i.e. jumpers—extend between segmented buses of adjacent zones to automatically control vehicle motion without external intervention. That is, the carrier-present bus in each zone is jumpered to the travel-permit bus of the preceding zone so that, in the event that a vehicle stalls in a given zone, motion of a vehicle entering the next-preceding zone is automatically arrested. Moreover, in the preferred embodiment of the invention, the travelpermit permit bus in each zone is jumpered to the segmented velocity control bus of the next-preceding zone. Thus, a stalled vehicle in a given zone not only automatically arrests motion of a vehicle in the immediately preceding zone, but also automatically reduces velocity of a vehicle entering the next-preceding zone so that, when such vehicle enters the zone immediately preceding the stalled vehicle, vehicle motion may be arrested without sudden stops. Of course, a vehicle in such immediately preceding zone whose motion has been arrested thereafter functions as a stalled vehicle so that motion of subsequent vehicles will likewise be arrested in preceding zones. In this way, collision among vehicles is automatically avoided without external control intervention.

BRIEF DESCRIPTION OF THE DRAWINGS

The invention, together with additional objects, features and advantages thereof, will be best understood from the following description, the appended claims and the accompanying drawings in which:

DETAILED DESCRIPTION

Figure 1:
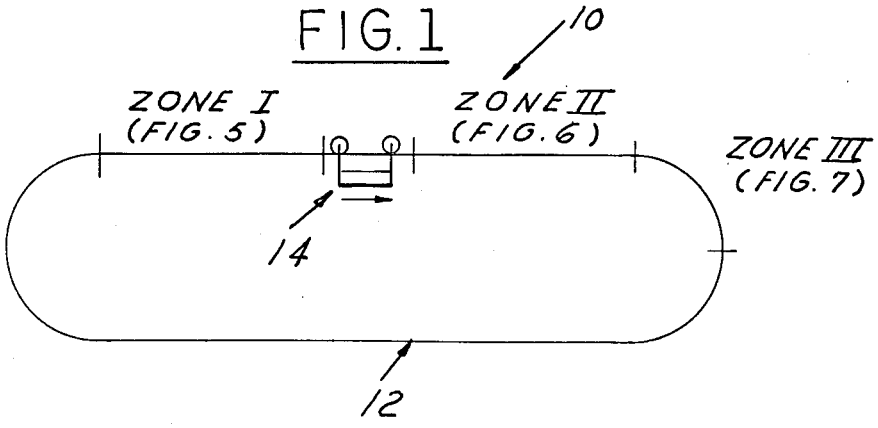
FIG. 1 is a schematic diagram of a transporation system which includes a closed track and a self-propelled vehicle for propulsion through sequential zones around the track.

A vehicle transportation system 10 is schematically illustrated in FIG. 1 as comprising a closed track 12 and a self-propelled vehicle 14 for clockwise propulsion around track 12 through a plurality of predesignated sequential zones—e.g. Zones I, II and III. Vehicle 14 may comprise a workpiece carrier vehicle with suitable hangers, etc. for transporting workpieces among work stations in an automated or sem-automated production line, and it is presently preferred to implement the principles of the present invention in such an automated production environment. However, it will become clear as the description unfolds that the principles of the invention are equally applicable in other transportation systems in which propulsion and control signals are fed to self-propelled vehicles from bus bars or rails positioned adjacent to the vehicle track. Zones I, II and III are respectively schematically illustrated in FIGS. 5, 6 and 7.

Figure 2:
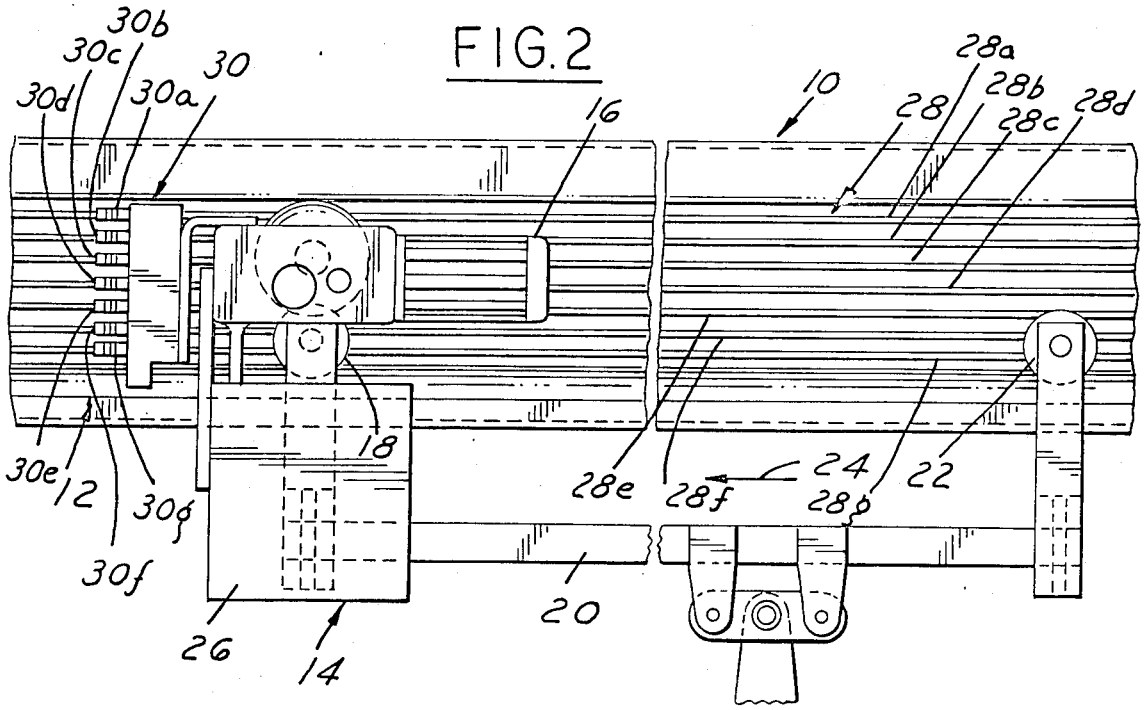
FIG. 2 is a fragmentary elevational view of the track and vehicle of FIG. 1.

FIG. 2 illustrates vehicle 14 in greater detail as comprising an electric motor 16 coupled to a drive wheel 18. A vehicle frame 20 is suspended from drive wheel 18 and an idler wheel 22 beneath track 12, with drive wheel 18 engaging track 12 for propelling vehicle 14 in the direction 24. Control electronics (FIG. 4) are contained within an enclosure 26 mounted on frame 20. A plurality of bus bars 28, specifically seven bus bars **28*a*–28*g* are positioned adjacent to track 12 and extend in a direction parallel thereto. A collector assembly 30 is carried by frame 20 of vehicle 14 and includes seven brushes or shoes 30*a*–30*g* for rolling or sliding mechanical contact with respective bus bars 28*a*–28*g*, and for thereby maintaining electrical contact therewith. Brushes 30*a*–30*g* are electrically connected to the control circuitry contained within enclosure 26**.

Figure 3:
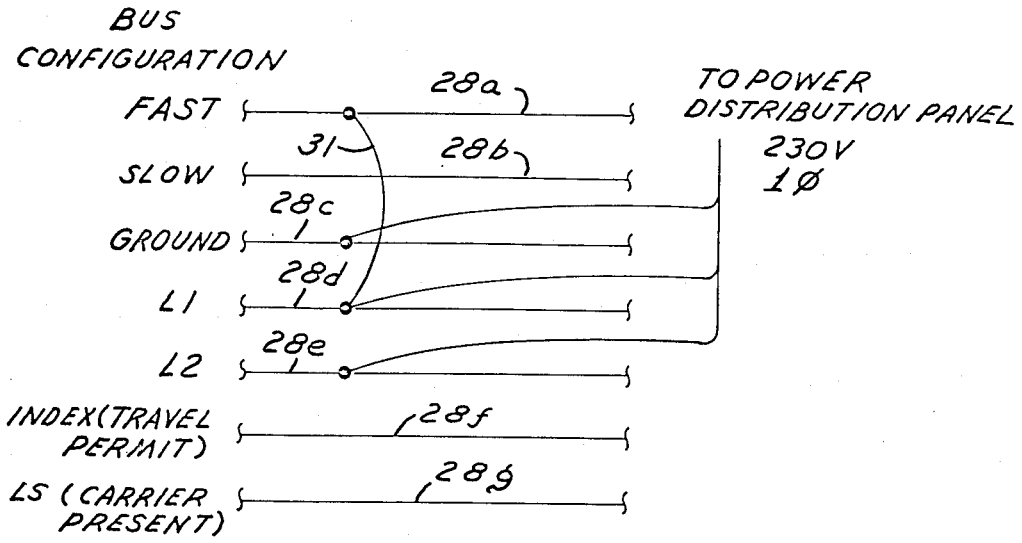
FIG. 3 is an electrical schematic diagram of power wiring to the track bus bars.

FIG. 3 schematically illustrates connection of electrical power to buses **28*a*–28*g*. AC power form a 230 V single phase poewr source or the like is connected to buses 28*c*–*e*, with buses 28*d* and 28*e* being connected to power lines L1 and L2 and bus 28*c* being connected to ground. Bus 28*d* is permanently connected by a jumper 31 to bus 28*a*, which thus carries a continuous ac signal for implementing fast propulsion at the vehicles in default of other velocity control signals. Bus 28*b* is designated the "SLOW" velocity control bus and cooperates with FAST bus 28*a* for controlling velocity of vehicle 14 as will be described. Bus 28*f* is designated the travel-permit bus and carries an INDEX signal. Likewise, bus 28*g* carries a signal LS indicative of presence of a carrier within a zone. Buses 28*a* and 28*c*–*e* are continuous through Zones I–III (FIGS. 1 and 5–7), while buses 28*b* and 28*f*–*g*** are segmented between adjacent Zones.

Figure 4:
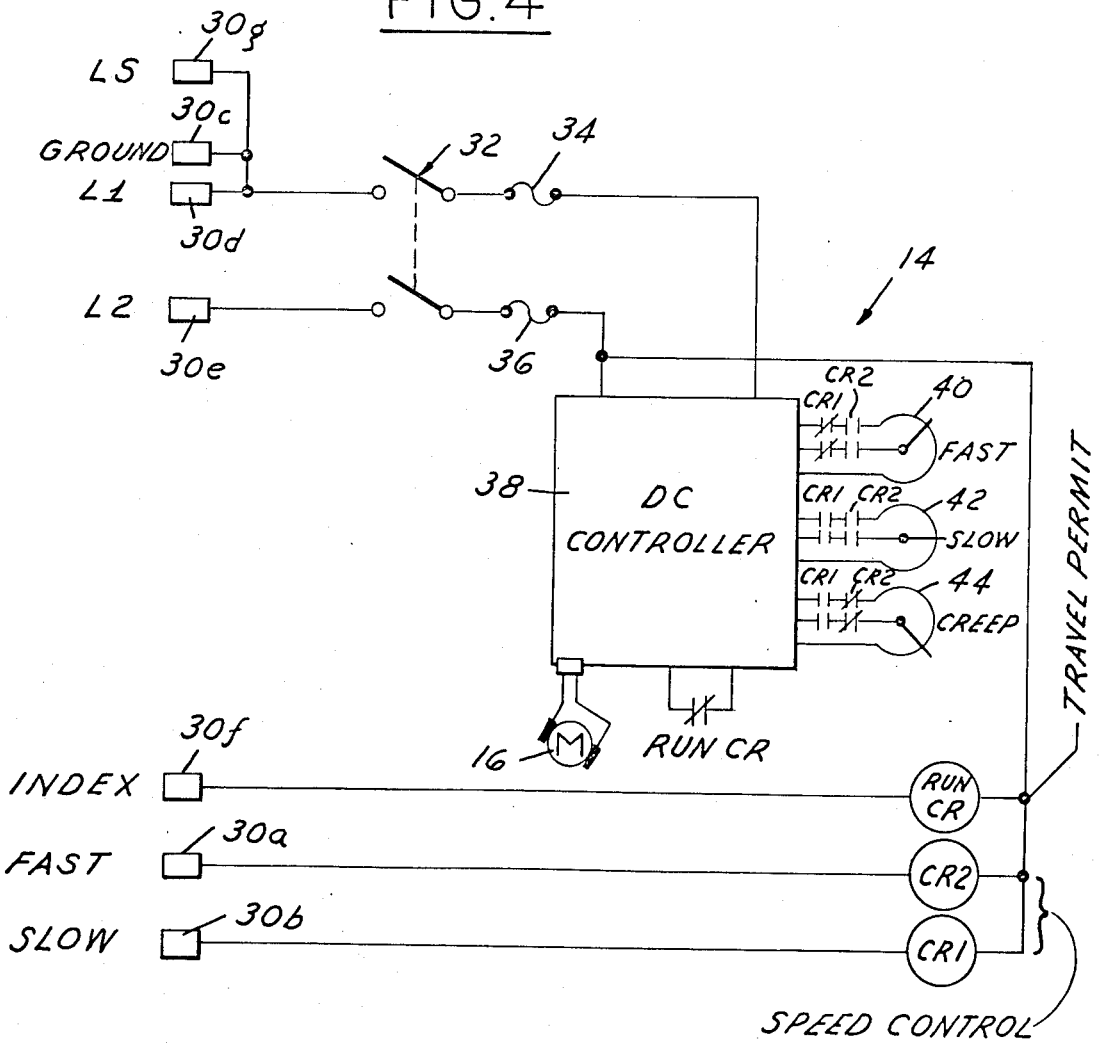
FIG. 4 is an electrical schematic diagram of the vehicle motion control circuitry.

FIG. 4 is an electrical schematic diagram of vehicle 14. The L1 and L2 power shoes **30*d* and 30*e* are connected through a vehicle power switch 32 and line fuses 34,36 to a dc controller 38. Shoe 30*d* is also directly connected to shoes 30*c* and 30*g* for placing line signal L1 on LS bus 28*g*. The fused side of the L2 power line is connected through the coils of relays RUN CR, CR2 and CR1 to the INDEX, FAST and SLOW shoes 30*f*,30*a* and 30*b* respectively. Relays CR1 and CR2 are speed control relays, and have normally closed and normally open contacts which selectively connect potentiometers 40,42, and 44 to dc controller 38 for controlling fast, slow and creep velocities of vehicle 14 respectively. Relay RUN CR has normally closed contacts connected to dc controller 38 for permitting motion of vehicle 14 only in the absence of a relay-energizing INDEX signal at shoe 30*f*. Controller 38 is connected to apply variable dc power to vehicle drive motor 16** (FIGS. 2 and 4).

In general, with switch 32 (FIG. 4) closed and with FAST bus **28*a* continuously connected to ac power (as shown in FIG. 3), relay CR2 is energized and relay CR1 is de-energized. Potentiometer 40 is thus connected to dc controller 38 through CR1 normally closed contacts and CR2 normally open contacts to control "fast" propulsion of vehicle 14 at a velocity which varies as a function of the setting at potentiometer 40. When SLOW bus 28*b* is also energized in parallel with FAST bus 28*a*, both relays CR1 and CR2 are energized, and potentiometer 42 is connected to controller 38 through CR1 and CR2 normally open contacts for controlling velocity of vehicle 14 at a "slow" speed proportional to the setting of potentiometer 42. In the event that power is removed from FAST bus 28*a* but maintained at SLOW bus 28*b*, relay CR1 is energized but relay CR2 is de-energized so as to connect potentiometer 44 to controller 38 through CR1 normally open contacts and CR2 normally closed contacts. Vehicle 14 is thus propelled at a "creep" velocity proportional to the setting of potentiometer 44. In the event that power is removed from both velocity control buses 28*a* and 28*b*, or in the event that power is applied to bus 28*f* to energize relay RUN CR and open the RUN CR normally closed contacts, power is removed from vehicle propulsion motor 16 and motion is arrested. It will be appreciated, of course, that the designations "fast," "slow" and "creep" in connection with potentiometers 40–44** are strictly arbitrary.

Figure 5:
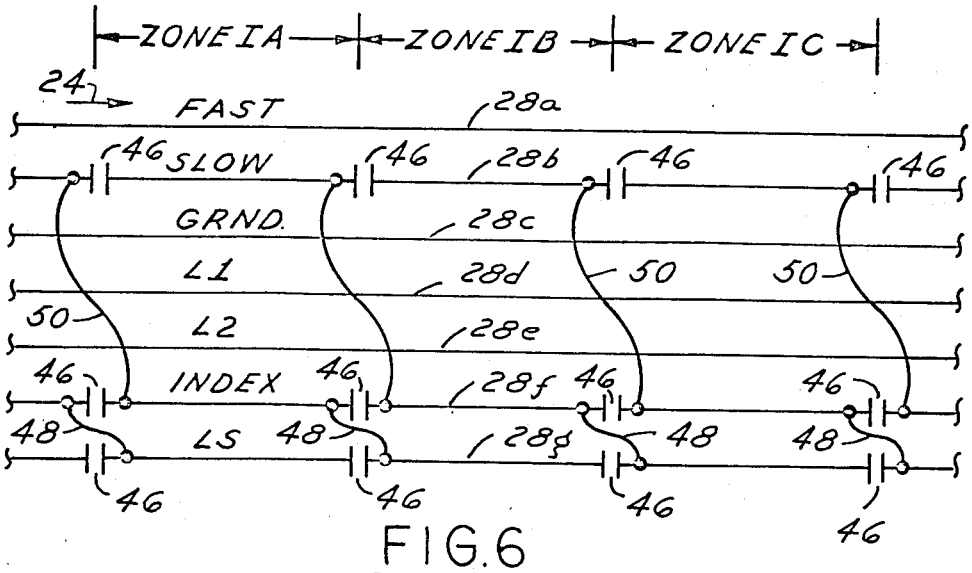
FIGS. 5–7 are fragmentary schematic diagrams of the bus bar interconnection configurations in respective Zones, I, II and III in FIG. 1.
Figure 6:
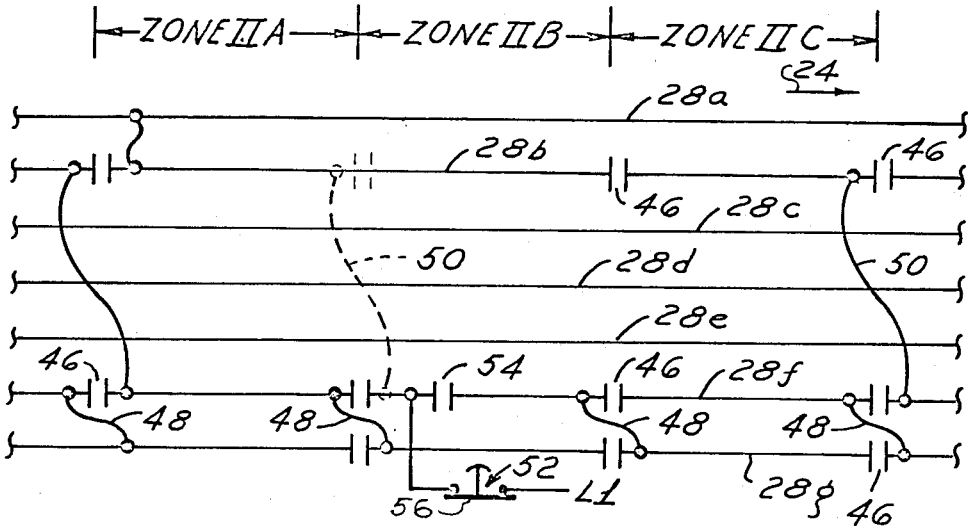
Figure 7:
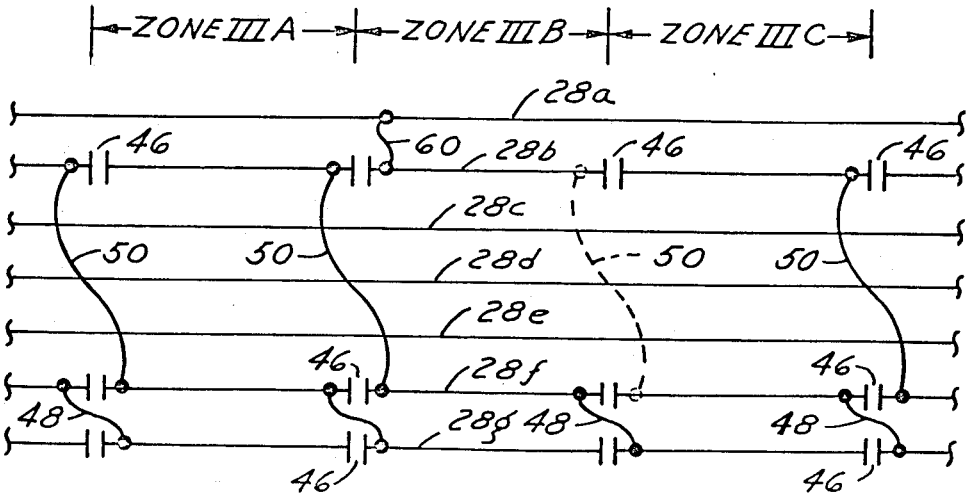

FIG. 5 illustrates bus bar interconnection in accordance with the present invention in Zone I, which is representative of a normal travel zone on track 12 (FIG. 1). Likewise, FIG. 6 illustrates bus bar interconnection in Zone II which includes a station at which vehicle motion must be arrested for permitting work to be performed by an operator or by automatic apparatus. Likewise, FIG. 7 illustrates bus bar interconnection in Zone III wherein vehicle velocity is automatically reduced for motion around a turn in track 12. Zones I, II and III in FIGS. 5–7 have been further divided into subzones A, B and C for purposes of explanation.

FIG. 5 illustrates bus bar interconnection in accordance with the basic principles of the present invention. Each of the SLOW, INDEX and LS buses **28*b*,28*f* and 28*g* are segmented or discontinuous between adjacent Zones IA, IB and IC, such discontinuities being at the entry to each zone (with reference to travel direction 24) and being illustrated schematically at 46. Each segment of bus 28*g* is directly electrically connected by a jumper 48 to the segment of INDEX bus 28*f* of the next-preceding zone. That is, the segment of LS bus 28*g* in Zone IC is connected by a jumper 48 to the segment of INDEX bus 28*f* in Zone IB, and the segment of bus 28*g* in Zone IB is connected to the segment of bus 28*f* in Zone IA, etc. Likewise, each segment of INDEX bus 28*f* is directly electrically connected by a jumper 50 to the segment of SLOW bus 28*b* in the next-preceding zone. That is, the segment of bus 28*f* in Zone IC is connected by a jumper 50 to the segment of bus 28*b* in Zone IB, and the segment of bus 28*f* in Zone IB is connected by a jumper 50 to the segment of bus 28*b*** in Zone IA, etc.

In operation, assume that a vehicle 14 (FIGS. 1–2 and 4) enters Zone I and travels in the direction 24 through Zones IA and IB, but stalls for whatever reason in Zone IC. Power line L1 is directly connected by vehicle 14 through shoe **30*g* (FIG. 4) to LS bus 28*g* in Zone IC, and thus by jumper 48 to segmented bus 28*f* in Zone IB. Furthermore, the L1 power line is connected by jumper 50 from bus 28*f* in Zone IB to bus 28*b* in Zone IA. Thus, in the event that a second vehicle approaches the vehicle stalled in Zone IC and enters Zone IA, jumpers 48,50 feed L1 line power to shoe 30***b* (FIG. 4) of the second vehicle in Zone IA to energize the CR1 relay of such second vehicle, effectively switching velocity control of such second vehicle from "fast" potentiometer 40 to "slow" potentiometer 42. Thus, the velocity of the second vehicle is slowed in Zone IA as it approaches the vehicle stalled in Zone IC. When the second vehicle thereafter enters Zone IB at "slow" velocity, and assuming that the first vehicle remains stalled in Zone IC, INDEX shoe 38*f* of the second vehicle is now effectively connected to L1 power by jumper 48 bridging Zones IB and IC so as to energize the RUN CR relay in the second vehicle, open the normally closed RUN CR contacts connected to controller 38, and thereby arrest motion of the second vehicle in Zone IB. Thus, collision is avoided between the second vehcle and the first vehicle stalled in Zone IC. Furthermore, the second vehicle now effectively applies L1 power to LS bus 28*g* in Zone IB, which is fed to the INDEX bus 28*f* in Zone IA. Bus 28*f* in Zone IA is likewise connected by a jumper 50 to the SLOW bus segment in the preceding zone so as to slow and arrest motion of a third vehicle in the event that such third vehicle approaches the first and second vehicles stalled in Zones IC and IB.

Thus, direct electrical interconnetion of bus segments in sequential zones in accordance with the basic principles of the present invention illustrated in FIG. 5 prevents collision between vehicles 14 carried by track 12 without the external control wihch is characteristic of the prior art. In the event that the first vehicle stalled in Zone IC now moves out of the zone, L1 power is removed from bus segment 28*g* in Zone IC and segment 28*f* in Zone 1B, so that the second vehicle in Zone IB is now permitted to move under control of velocity control buses 28*a* and 28*b*. Likewise, when the second vehicle moves from Zone IB to Zone IC, a third vehicle parked in Zone IA is likewise permitted to move. Note that when the second vehicle is in Zone IC, L1 power is applied to bus segment 28*g* in Zone IC, bus segment 28*f* in Zone IB and bus segment 28*b* in Zone IA so that the third vehicle parked in Zone IA is permitted to move only at "slow" velocity.

FIG. 6 illustrates approach to a work station 52 at which motion of vehicle 14 must automatically be arrested. An extra discontinuity 54 in bus 28*f* within Zone IIB isolates a portion of bus 28*f* which is normally connected by a pushbutton 56 to L1 power. In order to slow a vehicle approaching work station 52, bus 28*b* is directly electrically connected by a jumper 58 to bus 28*a* the entry to Zone IIA. Note that bus 28*b* is continuous through Zones IIA and IIB, so that vehicle velocity will automatically be reduced approaching work station 52 and will accelerate slowly toward Zone IIC from work station 52. In view of direct connection 58, there is no necessity in FIG. 6 for the jumper 50 (illustrated in phantom) between bus segments 28*b* and 28*f* in Zones IIA and IIB. As a vehicle approaches work station 52, velocity is automatically reduced in Zone IIA as previously described. Upon entry into Zone IIB, direct application of L1 power by switch 56 to bus 28*f* energizes the RUN CR relay (FIG. 4) in the vehicle so that motion is automatically terminated. Upon completion of operation on the workpiece carried by vehicle 14, pushbutton 56 is depressed to disconnect L1 power from bus 28*f* so that the vehicle may move in the direction 24 at "slow" speed under control of buses 28*a* and 28*b*. Upon entry into Zone IIC, the discontinuity 46 in Zones 28B returns velocity control to the FAST bus 28A and to jumpers 48,50 as previously described. Note that jumpers 48 bridging Zones IIA, IIB and IIB,IIC arrest motion of a second vehicle in the event that the first vehicle is positioned in either of the Zones IIB or IIC.

FIG. 7 illustrates bus bar interconnection for the purpose of slowing vehicle motion around a track turn. A jumper 60 directly connects bus 28*a* to bus 28*b* at the entry to Zone IIIB for slowing vehicle motion and at the same time removing any necessity for a jumper 50 (illustrated in phantom) between buses 28*b* and 28*f* in Zones IIIB and IIIC. Thus, vehicle velocity is automatically reduced in Zone IIIB independently of presence of other vehicles stalled upstream of this zone. Otherwise, vehicle motion is controlled in Zone III of FIG. 7 in the same manner as in Zone I of FIG. 5.

Although the invention has been described in detail in connection with a simplified continuous track 12, it will be appreciated that track switches or the like may be readily implemented employing otherwise conventional techniques. Likewise, the direct electrical connections or jumpers 48,50,58 and 60 may be readily implemented on the reverse side of the bus array 28 in FIG. 2 without interfering with vehicle motion.

The invention claimed is:

1. A transportation system comprising a track, a self-propelled vehicle for propulsion along said track in a predetermined vehicle direction through a plurality of predefined sequential track zones, a plurality of buses disposed adjacent to said track and extending through said zones, said buses including first, second and third buses in each said zone and being segmented from corresponding first, second and third buses in adjacent zones, said vehicle including at electric motor for propelling said vehicle, contact means for engaging said buses throughout said zones, means responsive through said contact means to electrical power on said first bus for retarding motion of said vehicle, means responsive through said contact means to electrical power on said second bus for arresting motion of said vehicle, and means for applying electrical power to said third bus, and direct electrical connection means including first means connecting each segment of said second bus to said third bus in the next-adjacent zone with respect to said direction of travel, and second means connecting each segment of said first bus to said second bus in the next-adjacent zone in said direction of travel, such that presence of a vehicle in one of said zones automatically arrests motion of a vehicle in the first zone next-preceding said one zone and automatically retards motion of a vehicle in the second zone next-preceding said one zone.

2. A vehicle transportation system comprising a track extending through a sequence of predefined adjacent zones, a plurality of parallel bus bar means positioned adjacent to said track, said bus bar means including first and second bus bars for carrying speed control signals, a third bus bar and a fourth bus bar, said first bus bar extending continuously through said zones and each of said second, third and fourth bus bars being in aligned but electrically disconnected segments in said zones, and fifth bus bars extending continuously through said zones and carrying electrical power.

a self-propelled vehicle including bus-contact means for electrical contact with said bus bar means throughout said zones, electrical drive means for propelling said vehicle along said track in a predetermined direction through said zones in sequence, first circuit means responsive through said contact means to electrical power on said first and second bus bars for controlling velocity of said vehicle, second circuit means responsive through said contact means to electrical power on said third bus bar for arresting motion of said vehicle, and third circuit means for applying electrical power from said fifth bus bars to said fourth bus bar through said contact means, and direct electrical connection means connecting each segment of said second bus bar in each said zone with said third bus bar in the next-adjacent zone in said predetermined direction, and connecting each segment of said third bus bar in each said zone with said fourth bus bar in the next-adjacent zone in said direction.

3. A vehicle transportation system comprising a track, a self-propelled vehicle for propulsion along said track in a predetermined direction through a plurality of predefined sequential track zones;

a plurality of buses adjacent to said track and extending through said zones for applying motion control signals to a vehicle on said track, said buses including first and second buses for applying speed conrol signals to said vehicle, and third and fourth signal buses, said third and fourth buses being segmented between successive zones and said second bus being segmented between at least some of said zones, said vehicle including bus-contact means for receiving electrical signals from said plurality of buses, electric drive means, means responsive to presence or absence of electrical power on said first bus for selectively applying power to said drive means, means responsive through said contact means to electrical power on said second bus for reducing velocity of said vehicle, means responsive through said contact means to electrical power on said third bus for arresting motion of said vehicle, and means applying electrical power to said fourth bus through said contact means, first means electrically connecting the said fourth bus in each said zone to the said third bus in the immediately preceding zone with respect to said predetermined vehicle direction, and second means electrically connecting said second bus in selected ones of said zones to the said third bus in the immediately preceding said zone with respect to said predetermined vehicle direction, such that presence of a vehicle in one of said zones operates automatically through said first means to arrest motion of a vehicle entering the immediately preceding zone and through said second means to reduce velocity of a vehicle entering the next-preceding zone.

4. The system set forth in claim 3 further comprising means electrically connecting segmented sections of said second bus to said first bus in zones other than said selected ones of said zones.

* * * * *

UNITED STATES PATENT AND TRADEMARK OFFICE

CERTIFICATE OF CORRECTION

PATENT NO. : 4,688,487

DATED : August 25, 1987

INVENTOR(S) : Donald L. Dollens et al

It is certified that error appears in the above-identified patent and that said Letters Patent are hereby corrected as shown below:

Column 1, line 8, "seqential" should be --sequential--
Column 1, line 34, "applications" should --application--
Column 1, line 52, "sening" should be --sensing--
Column 2, line 28, delete extra "permit"
Column 3, line 3, "sem-automated" should be --semi-automated--
Column 3, line 32, "poewr" should be --power--
Column 5, line 17, "vehcle" should be --vehicle--
Column 5, line 31, "wihch" should be --which--
Column 6, line 37, "at" should be --an--

Signed and Sealed this

Ninth Day of February, 1988

*Attest:*

DONALD J. QUIGG

*Attesting Officer*

*Commissioner of Patents and Trademarks*